US011098971B2

(12) United States Patent
Guillen et al.

(10) Patent No.: US 11,098,971 B2
(45) Date of Patent: Aug. 24, 2021

(54) MUZZLE BRAKE

(71) Applicant: Highland Canyon Company, Inc., Boise, ID (US)

(72) Inventors: Gustavo Guillen, Boise, ID (US); John Roy Ianson, Boise, ID (US)

(73) Assignee: Highland Canyon Company, Inc., Boise, ID (US)

( * ) Notice: Subject to any disclaimer, the term of this patent is extended or adjusted under 35 U.S.C. 154(b) by 329 days.

(21) Appl. No.: 16/351,240

(22) Filed: Mar. 12, 2019

(65) Prior Publication Data

US 2020/0292269 A1 Sep. 17, 2020

(51) Int. Cl.
*F41A 21/36* (2006.01)

(52) U.S. Cl.
CPC ..... *F41A 21/36* (2013.01)

(58) Field of Classification Search
CPC ..... F41A 21/36
USPC ..... 89/14.3
See application file for complete search history.

(56) References Cited

U.S. PATENT DOCUMENTS 2,662,326 A * 12/1953 Baden ..... F41A 21/42 42/79
2,712,193 A * 7/1955 Mathis ..... F41A 21/42 42/79
3,187,633 A * 6/1965 Tanabe ..... F41A 21/36 89/14.3
5,814,757 A * 9/1998 Buss ..... F41A 21/36 89/14.3
7,143,680 B2 * 12/2006 Bender ..... F41A 21/38 89/14.3
7,353,741 B2 * 4/2008 Brixius ..... F41A 13/06 42/90
9,207,034 B2 * 12/2015 Larson, Jr. ..... F41A 21/36
9,303,939 B1 * 4/2016 Brinkmeyer ..... F41A 21/38
9,377,263 B1 * 6/2016 Sy ..... F41A 21/36
10,088,261 B1 * 10/2018 Oglesby ..... F41A 21/325
10,670,362 B2 * 6/2020 Wilson ..... B23K 35/304
10,788,283 B2 * 9/2020 Joplin ..... F41A 21/38

* cited by examiner

*Primary Examiner* — Samir Abdosh
(74) *Attorney, Agent, or Firm* — Christensen O'Connor Johnson Kindness, PLLC

(57) ABSTRACT

A muzzle brake for a firearm provided herein generally includes a housing having a chamber and an insert removably couplable to the housing such that the insert is interchangeable depending on the caliber of projectile. The insert includes a body with a central bore defining a projectile axis, the central bore at least partially extending toward an end of the housing within the chamber. The muzzle brake may further include a first lateral port extending from the chamber through the housing and be configured to expel combustion gases away from the housing and a first baffle projecting radially from the body and disposed at a location along the body configured to direct a portion of the combustion gases toward the first lateral port. The muzzle brake may further include an upward port configured to expel combustion gases in direction to counteract muzzle lift of the firearm.

20 Claims, 6 Drawing Sheets

MUZZLE BRAKE

BACKGROUND

A muzzle brake is a device generally used with a firearm configured to expel a projectile using gas pressure derived from combustion of a propellant, such as gunpowder. The muzzle brake redirects the gases of the propellant combustion to counteract recoil and muzzle rise, among other uses. In some instances, the muzzle brake may be referred to as a recoil compensator.

In some examples, the muzzle brake includes directional ports, cutouts, chambers, or other passageways and openings to generally direct the gases in a direction that creates a force to counteract the forces created by the expulsion of the projectile and propellant combustion gases when using the firearm. The design of the muzzle brake determines the percentage of combustion gases diverted and the venting direction. Various types of muzzle brakes are used for firearms, including linear compensators, which redirect the combustion gases forward in the direction of the projectile, side/lateral compensators, which redirect the combustion gases to the sides, and reverse compensators, which redirect the gases in a direction opposite the direction of the projectile.

By reducing recoil and/or muzzle rise, the muzzle brake generally improves the accuracy of the shooter, particularly when firing in rapid succession, reduces fatigue of the shooter by reducing the force of recoil imparted to the shooter, among other advantages. Conventional muzzle brakes are sized to be used with a single caliber projectile, and must be replaced if the caliber of the firearm is changed.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one embodiment of the present disclosure, a muzzle brake for a firearm is provided. The muzzle brake generally includes a housing having a chamber, a proximal end, and a distal end, and an insert removably couplable to the distal end of the housing, the insert having a body with a central bore defining a projectile axis, the central bore at least partially extending toward the proximal end of the housing within the chamber. The muzzle brake may further include a first lateral port extending from the chamber through the housing and configured to expel combustion gases away from the housing and a first baffle projecting radially from the body and disposed at a location along the body configured to direct a portion of the combustion gases toward the first lateral port.

In accordance with another embodiment of the present disclosure, a muzzle brake assembly is provided. The muzzle brake assembly generally includes a housing having a chamber with a first lateral port extending therethrough configured to expel combustion gases away from the housing with a velocity component toward a proximal end of the housing, and an insert removably coupled to a distal end of the housing, the insert having an elongate body with a central bore defining a projectile axis, the central bore at least partially extending toward the proximal end of the housing within the chamber. The muzzle brake may further include a first baffle projecting radially from the elongate body and disposed at a location along the elongate body configured to direct a portion of the combustion gases toward the first lateral port.

In accordance with another embodiment of the present disclosure, a firearm having a muzzle brake is provided. The firearm generally includes a barrel and a muzzle brake assembly disposed at an end of the barrel configured to expel a projectile. The muzzle brake assembly may include a housing having a chamber with a first lateral port and an upward port extending therethrough configured to expel combustion gases away from the housing with a velocity component toward the barrel; an insert removably coupled to a distal end of the housing, the insert having an elongate body with a central bore defining a projectile axis, the central bore at least partially extending from the distal end toward the barrel within the chamber; and a first baffle projecting radially from the tube body and disposed at a location along the tube body configured to direct a portion of the combustion gases toward the first lateral port and the upward port In accordance with any of the embodiments described herein, the first lateral port may include two apertures extending from the chamber through the housing, the apertures being mirror symmetrical to each other about a vertical plane intersecting the projectile axis.

In accordance with any of the embodiments described herein, the first lateral port may be disposed at an angle such that the combustion gases have a velocity component toward the proximal end during expulsion.

In accordance with any of the embodiments described herein, the muzzle brake may further include an upward port extending from the chamber through the housing and configured to expel combustion gases away from the housing in direction corresponding to the direction of muzzle lift of the firearm.

In accordance with any of the embodiments described herein, the upward port may be disposed at an angle such that the combustion gases have a velocity component toward the proximal end during expulsion.

In accordance with any of the embodiments described herein, the body may form an elongate tube and an end of the body facing the proximal end includes a tapered portion configured to divert a portion of the combustion gases into the chamber toward the first baffle.

In accordance with any of the embodiments described herein, the muzzle brake may further include a second lateral port pair extending from the chamber through the housing and configured to expel combustion gases away from the housing, and a second baffle projecting radially from the body and disposed at location along the body configured to direct a portion of the combustion gases toward the second lateral port pair.

In accordance with any of the embodiments described herein, the insert may be removably couplable to the housing using mechanical connection selected from the group consisting of a threaded joint, twist-to-lock features, a retaining ring, a clamp, a pin, interference fit, and welding.

In accordance with any of the embodiments described herein, the insert may include an engaging feature configured to aid in installation and removal of the insert from the housing.

In accordance with any of the embodiments described herein, the housing may include a mechanical coupling portion configured to interface a barrel of the firearm, the mechanical coupling selected from the group consisting of a threaded joint, twist-to-lock features, a retaining ring, a clamp, a pin, interference fit, and welding.

DESCRIPTION OF THE DRAWINGS

The foregoing aspects and many of the attendant advantages of the present disclosure will become more readily appreciated as the same become better understood by reference to the following detailed description, when taken in conjunction with the accompanying drawings, wherein.

DETAILED DESCRIPTION

Figure 1:
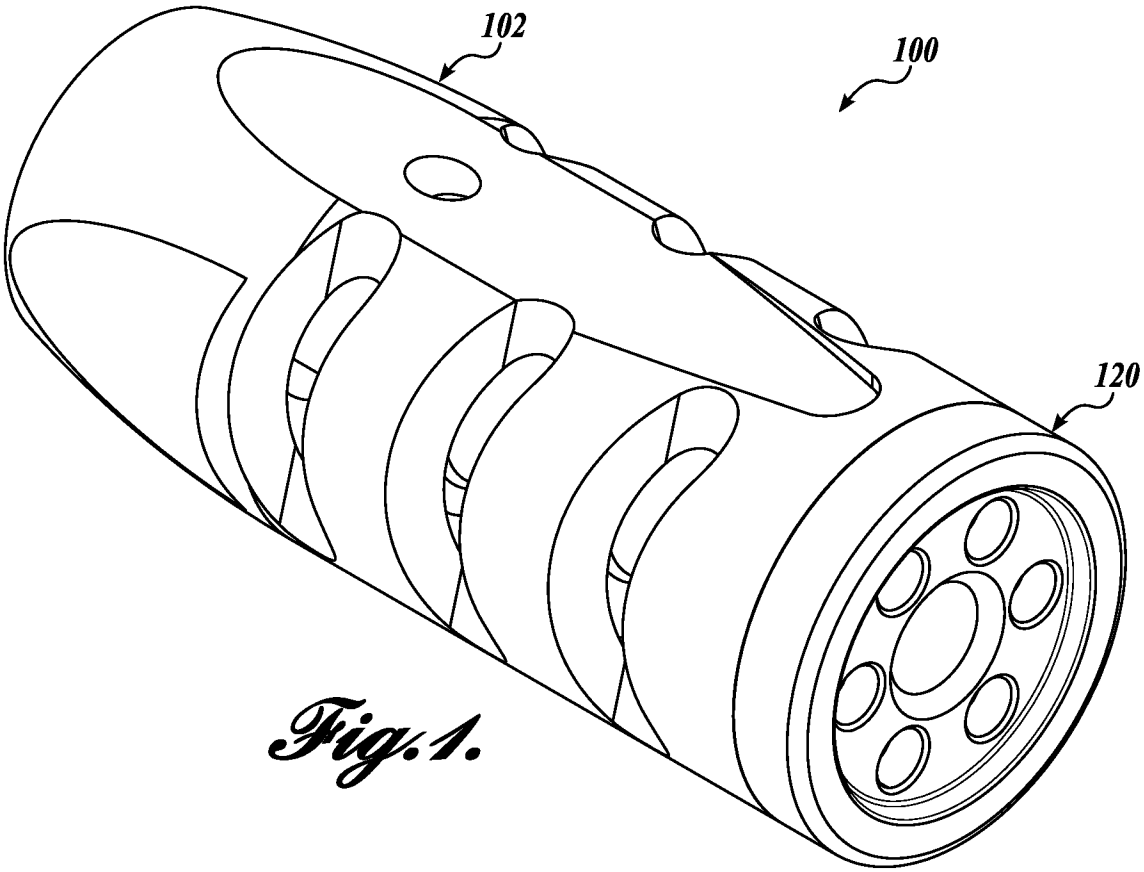
FIG. 1 is a left front top perspective view of one representative embodiment of muzzle brake in accordance with an aspect of the present disclosure.

The detailed description set forth below in connection with the appended drawings, where like numerals reference like elements, are intended as a description of various embodiments of the present disclosure and are not intended to represent the only embodiments. Each embodiment described in this disclosure is provided merely as an example or illustration and should not be construed as precluding other embodiments. The illustrative examples provided herein are not intended to be exhaustive or to limit the disclosure to the precise forms disclosed.

In the following description, specific details are set forth to provide a thorough understanding of exemplary embodiments of the present disclosure. It will be apparent to one skilled in the art, however, that the embodiments disclosed herein may be practiced without embodying all of the specific details. In some instances, well-known process steps have not been described in detail in order not to unnecessarily obscure various aspects of the present disclosure. Further, it will be appreciated that embodiments of the present disclosure may employ any combination of features described herein.

Muzzle brakes are generally used with firearms to constrain and redirect the gases of the propellant combustion during the firing of a projectile. In particular, redirection of the gases can counteract recoil, a linear force acting on the firearm in the opposite direction from the travel of the projectile, and muzzle rise, a rotational force acting on the firearm caused by the linear recoil force acting in a vector offset from the center of gravity of the firearm. The rotational force tends to cause the muzzle, e.g., the end of the barrel, to raise off-target in the recoil event after the projectile is expelled. Recoil has several disadvantages. Excessive recoil can lead to shooter pain, fatigue, and reflexive twitching, each detrimental to accuracy and overall effectiveness of the firearm. As muzzle rise effects increase, the firearm becomes more difficult to control during use, especially in quick-burst firing situations. Reducing recoil and muzzle rise can increase the shooter's accuracy, control, and enjoyment while using the firearm. In some instances, the muzzle brake may be referred to as a recoil compensator.

The following description provides several examples that relate to muzzle brakes for use with firearms. Embodiments of the present disclosure are generally directed to muzzle brakes having an insert removably coupled to a housing, such that the insert may be replaced while retaining the same housing portion. In this regard, the insert includes a central bore that is sized to correspond to a specific caliber of projectile. If the projectile caliber is changed, the insert portion may be replaced with another suitable insert for using the muzzle brake with a different caliber. Using the embodiments of the present disclosure, a shooter may transfer the muzzle brake from one firearm to another without needing to have multiple muzzle brakes for each caliber firearm.

An inserted muzzle brake generally includes various ports and baffles to redirect the gases from the propellant combustion during use of the firearm. As the gases exhaust from the barrel of the firearm, a portion of the gas is redirected through one or more ports to reduce recoil and muzzle rise. In some embodiments, the muzzle brake includes one or more ports directed to counteract the recoil of the firearm and one or more separate ports directed to counteract the muzzle rise of the firearm. In other embodiments, the muzzle brake includes one or more ports directed to counteract both the recoil and the muzzle rise of the firearm. In the embodiments shown herein, a plurality of lateral ports and a single upward-facing port are included; however, in other embodiments, any port configuration is within the scope of the present disclosure.

Referring initially to FIG. 1, a muzzle brake 100 generally includes a housing 102 and an insert 120. In some embodiments, the insert 120 is removably couplable to the housing 102 using a threaded connection. In other embodiments, the insert 120 is removably couplable to the housing 102 using any suitable attachment, such as twist-to-lock, a retaining ring, a clamp, a pin, interference fit, and welding etc. In this regard, the coupling must withstand the forces generated by the combustion gases exiting the barrel of the firearm such that the insert 120 does not separate from the housing 102 during use.

Figure 2:
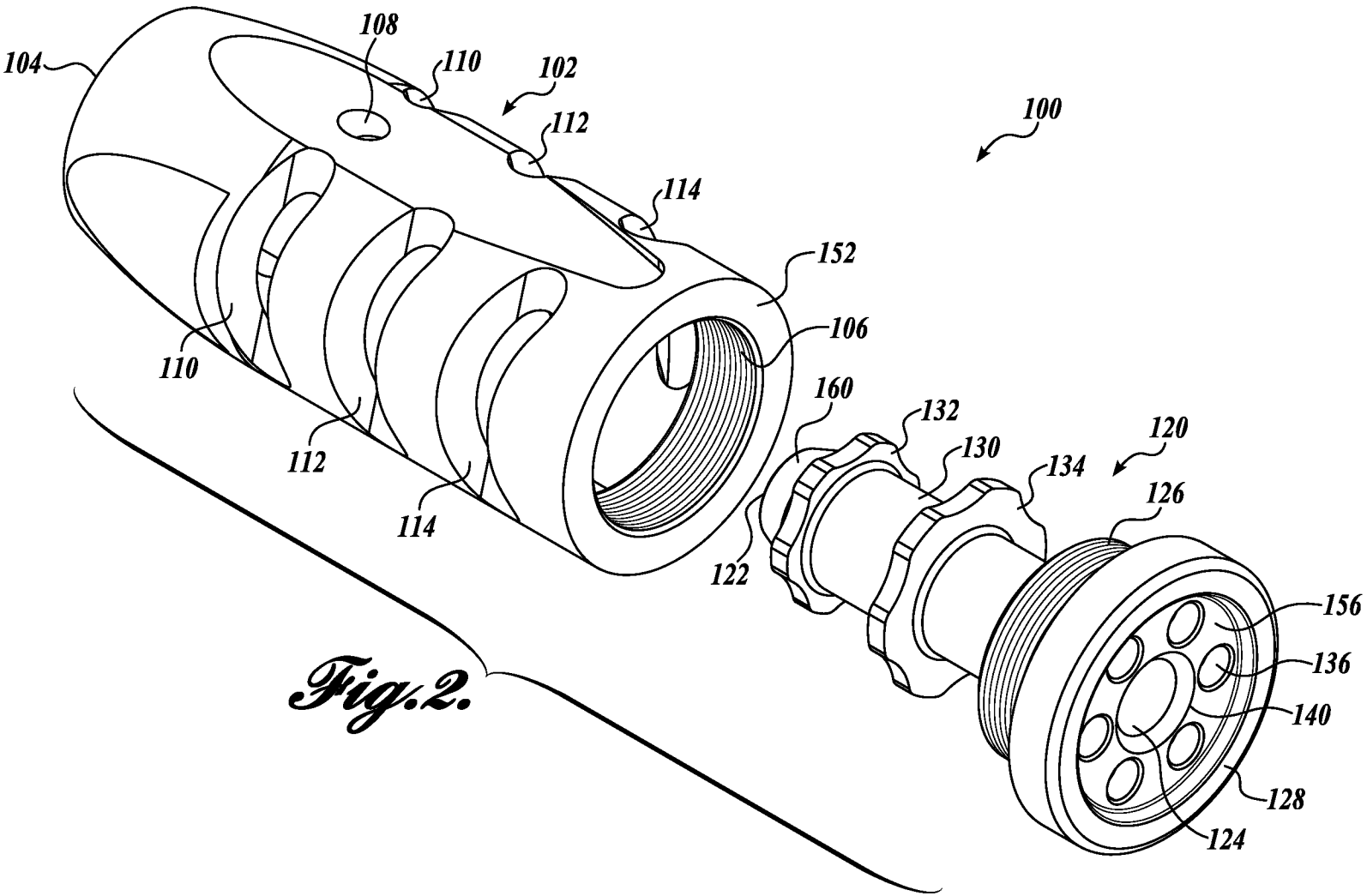
FIG. 2 is an exploded left front top perspective view of the muzzle brake of FIG. 1.
Figure 3:
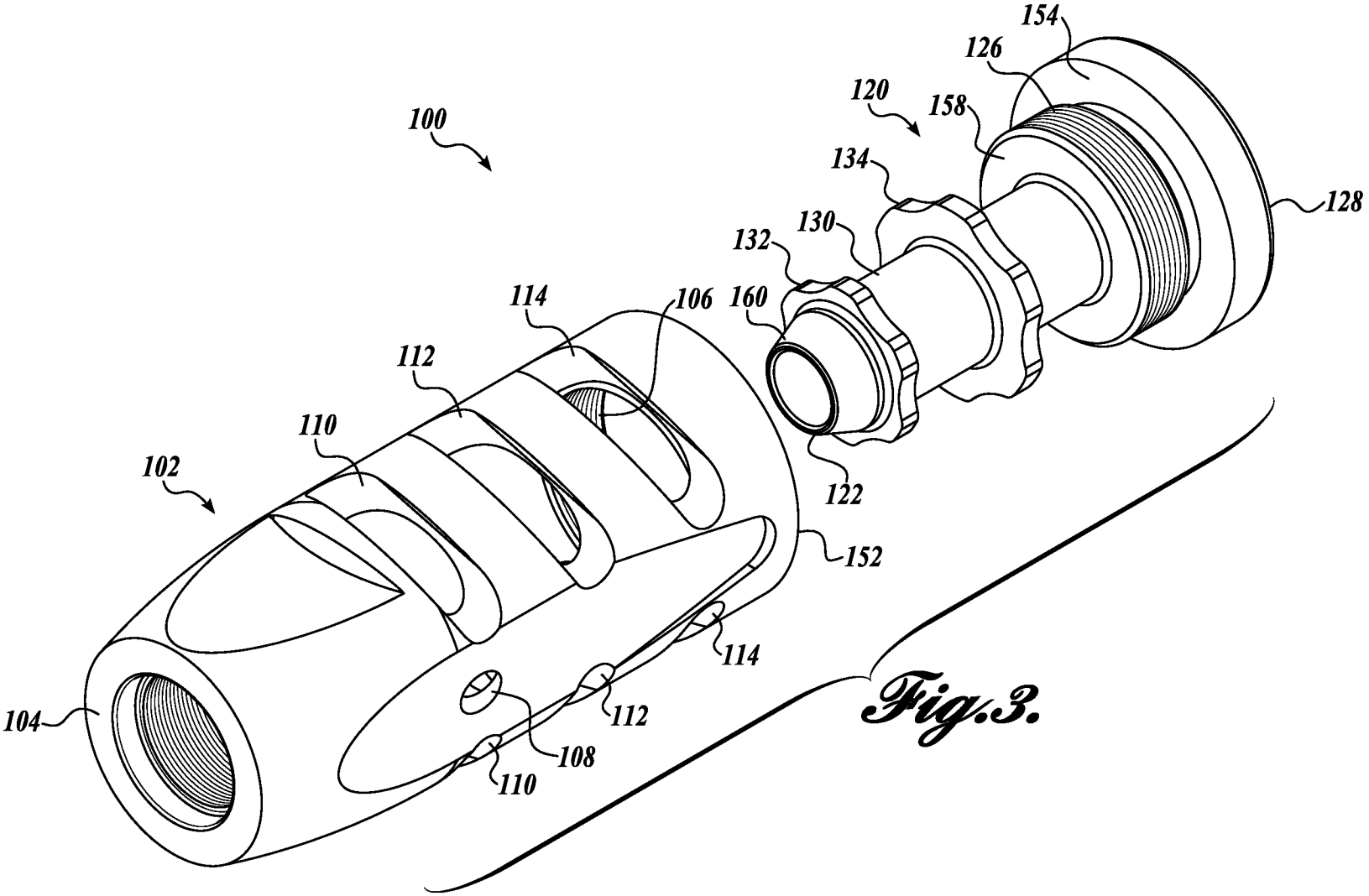
FIG. 3 is an exploded left rear bottom perspective view of the muzzle brake of FIG. 1.

Turning now to FIGS. 2 and 3, the muzzle brake 100 is shown in an exploded configuration, with the housing 102 and the insert 120 separated. The housing 102 includes a proximal end 104, a distal end 152, and a main central cavity 148 (see FIG. 10), in which the insert 120 is received. The insert 120 includes a proximal end 122, a distal end 128, and a central bore 124, through which the projectile (e.g., a bullet, not shown) travels during use of the firearm.

In the illustrated embodiments, the housing 102 includes a threaded receiving surface 106 positioned near the distal end 152. The threaded receiving surface 106 is configured to interface a threaded engaging surface 126 of the insert 120, such that the insert 120 can be removably assembled to the housing 102 during use. In some embodiments, when the insert 120 is assembled to the housing 102, the distal end 152 of the housing 102 abuts an assembly surface 154 of the insert 120 to form a secure connection. To aid in the installation and removal of the insert 120 to and from the housing 102, the insert 120 may include a feature, such as one or more engagement apertures 136 disposed in a distal face 156, to interface a tool (not shown) such that torque may be applied to the insert 120. In the illustrated embodiment, the distal face 156 is inset from the distal end 128 of the insert 120. In other embodiments, the distal face 156 may be flush with the distal end 128, or may have any other suitable configuration.

Using the embodiments disclosed herein, multiple inserts 120 may be configured for use with a single housing 102. In this regard, the size of the central bore 124 may be suitably adjusted to correspond to the caliber of the projectile. Although the central bore 124 is not generally configured to directly interface or touch the projectile, as in the case of the barrel bore of the firearm, the size of the central bore 124 may be specified based on the caliber of the projectile. In some embodiments, the central bore 124 defines a projectile axis, along which the projectile travels, and has a diameter that is from about 0.003 mm to 0.080 mm larger than the caliber of the projectile. In other embodiments, the central bore 124 has a diameter that is from about 0.015 mm to 0.045 mm larger than the caliber of the projectile. In further embodiments, the central bore 124 has a diameter that is about 0.030 mm larger than the caliber of the projectile.

Features of the housing 102 will now be explained in greater detail with reference to FIGS. 2, 3, and 8-10. The housing 102 has a generally hollow configuration with the main central cavity 148 sized and configured to accept the insert 120 therein. The proximal end 104 of the housing 102 includes an inlet bore 146 extending from the proximal end 104 to the main central cavity 148. In the illustrated embodiments, the inlet bore 146 is threaded (see FIGS. 3 and 10) to engage the end of a threaded barrel (not shown) for attachment of the muzzle brake 100 to the firearm. In embodiments using such threads, a clearance bore 142 is included to aid in the attachment of the muzzle brake 100 to the barrel of a firearm. In these embodiments, the clearance bore 142 provides clearance to the threads on the barrel such that the threads are able to engage the threads on the inlet bore 146. In other embodiments, the clearance bore 142 or inlet bore 146 includes an aperture for welded attachment of the muzzle brake 100 to the barrel of the firearm, such as with a spot weld. In further embodiments, the housing 102 is removably couplable to the barrel using any suitable attachment, such as twist-to-lock, a retaining ring, a clamp, a pin, interference fit, and welding etc. In the illustrated embodiments, the inlet bore 146 transitions to the main central cavity 148 using a sudden expansion chamfer 150. In other embodiments, the transition from the inlet bore 146 to the main central cavity 148 may be flat, curved, arcuate, or any other suitable transition.

In some embodiments, the housing 102 includes an upward port 108 extending from the main central cavity 148 through the housing 102. During use of the firearm, a portion of the gases expelled from the barrel are directed through the upward port 108 to create a counteracting force in a general direction aligned with an axis of the upward port 108. When the muzzle brake 100 is installed on the firearm, the muzzle brake 100 is generally clocked on the barrel such that the upward port 108 is aligned in a direction to counteract the muzzle rise during use of the firearm. In some embodiments, the upward port 108 is clocked in a position at 0° from vertical with respect to the projectile axis of the central bore 124, counteracting muzzle rise in a generally vertical direction. In other embodiments, the upward port 108 is clocked in a position at an angle from vertical such that the direction of the force caused by the gases traveling through the upward port 108 is aligned with the direction of muzzle rise. In this regard, the muzzle brake 100 can be tuned to counteract off-axis muzzle rise, such as when certain components or configurations cause the muzzle to rise in a direction other than 0° from vertical.

Figure 10:
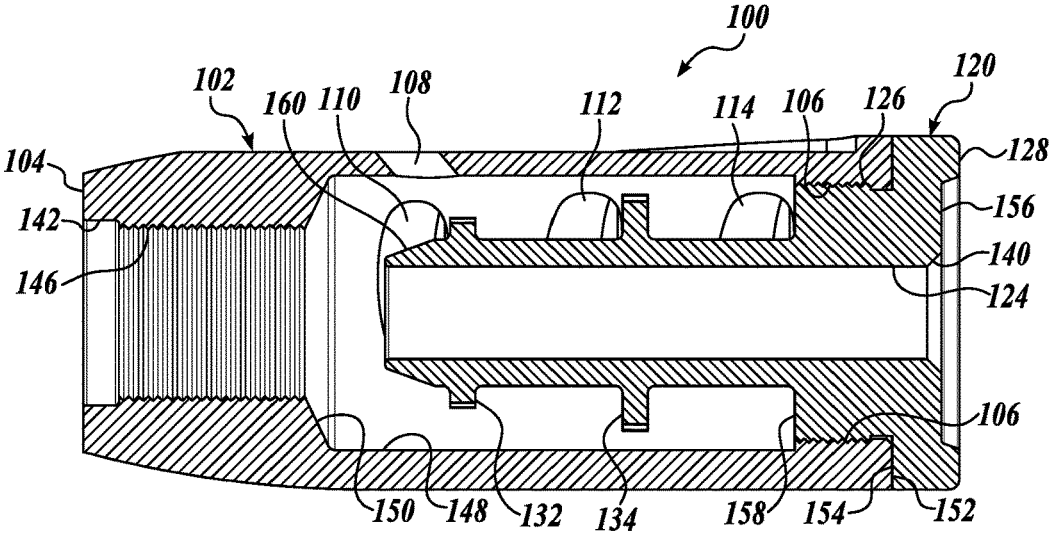
FIG. 10 is cutaway left elevational view of the muzzle brake of FIG. 1, taken along the cut line 10-10 shown in FIG. 4.

As shown in FIG. 10, in some embodiments, the upward port 108 is angled such that the combustion gases exit the upward port 108 having a velocity component toward the proximal end 104 of the housing 102. In the illustrated configuration, the upward port 108 may contribute to the reduction of recoil during use of the firearm. In other embodiments, the upward port 108 is disposed at any suitable angle. Although a single upward port 108 is depicted in the FIGURES, a plurality of upward ports, having any suitable shape or diameter, is also within the scope of the present disclosure.

Figure 4:
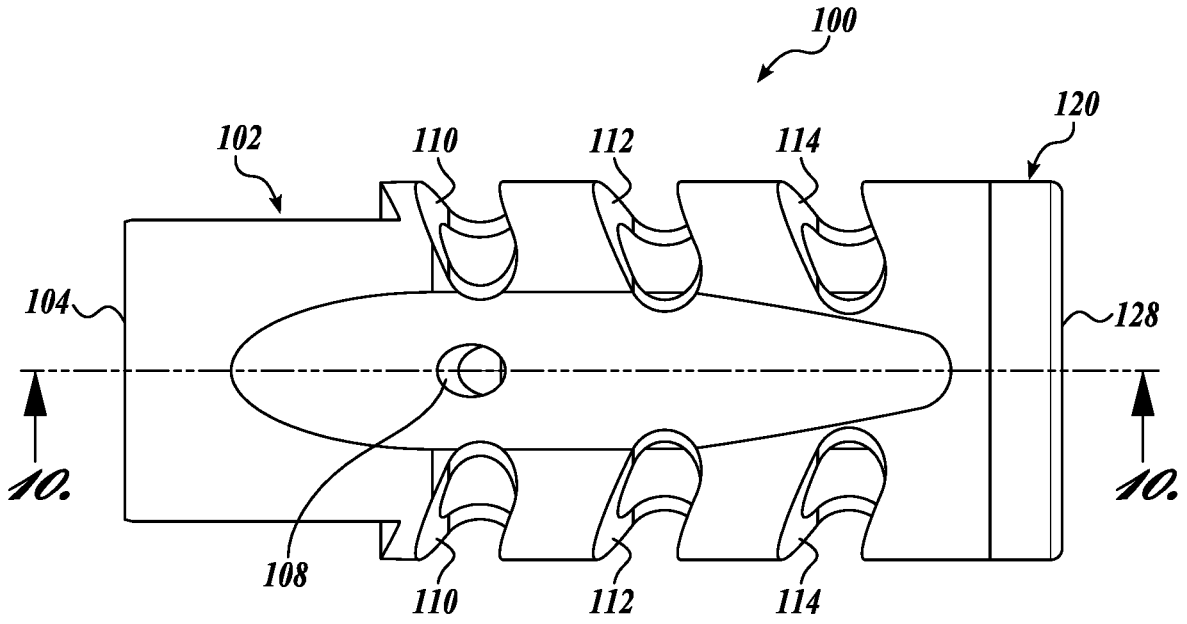
FIG. 4 is top plan view of the muzzle brake of FIG. 1.
Figure 5:
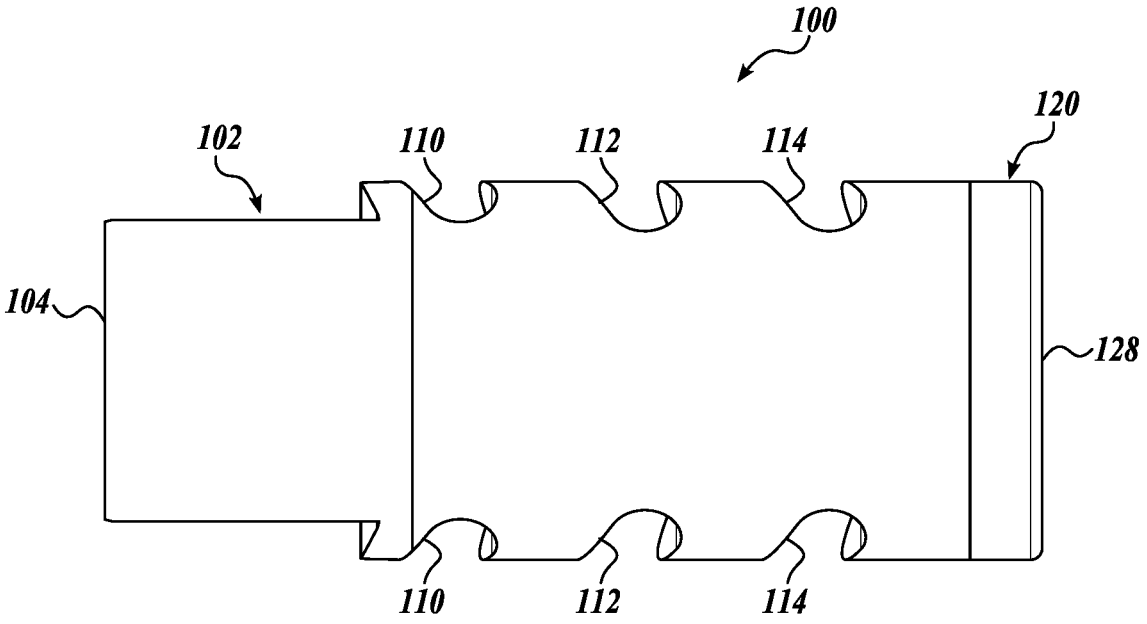
FIG. 5 is bottom view of the muzzle brake of FIG. 1.

In some embodiments, the housing 102 includes opposing first lateral ports 110, second lateral ports 112, and third lateral ports 114. In these embodiments, each pair of lateral ports is opposing across a mid-plane of the housing 102 to balance the force generated from the gases exiting the lateral ports. The first, second, and third lateral ports 110, 112, and 114 extend from the main central cavity 148 through the housing 102. As with the upward port 108, during use of the firearm, a portion of the gases expelled from the barrel are directed through one or more of the first, second, and third lateral ports 110, 112, and 114 to create a counteracting force in a general direction aligned with the first, second, and third lateral ports 110, 112, and 114. As shown most clearly in FIGS. 4 and 5, in some embodiments, the first, second, and third lateral ports 110, 112, and 114 are angled such that the combustion gases exit the lateral ports in a direction tending toward the proximal end 104 of the housing 102. In this regard, the first, second, and third lateral ports 110, 112, and 114 contribute to the reduction of recoil during use of the firearm as the force generated by the expulsion of gases through the lateral ports has a component in the direction toward the distal end 152 of the housing 102, opposite the direction of the recoil force as a result of the expelled projectile.

Figure 6:
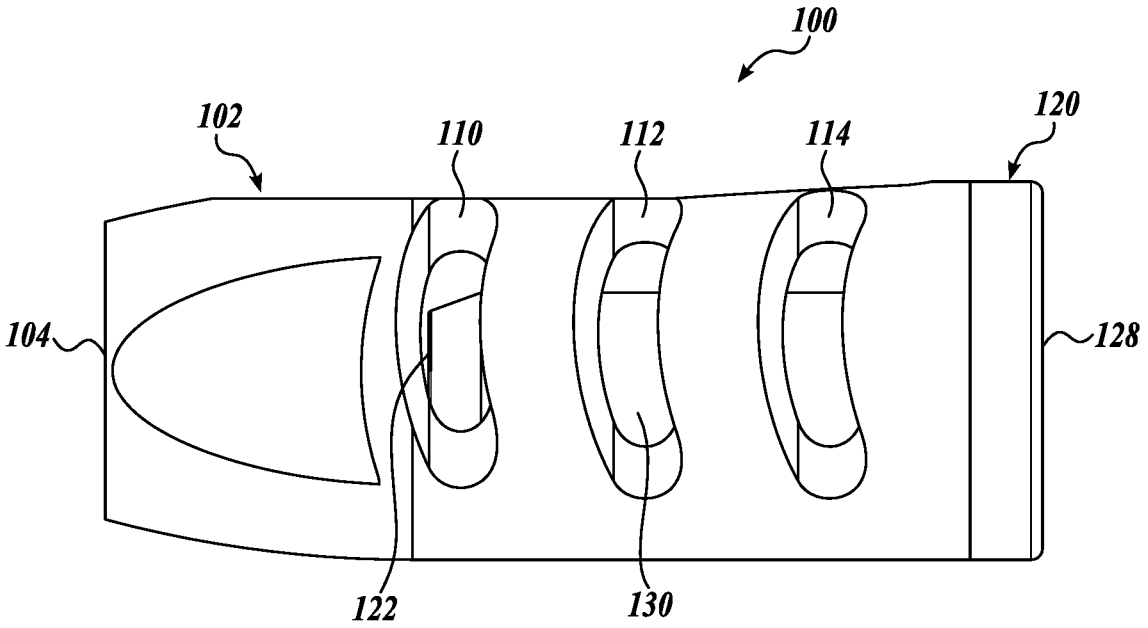
FIG. 6 is left elevational view of the muzzle brake of FIG. 1.
Figure 7:
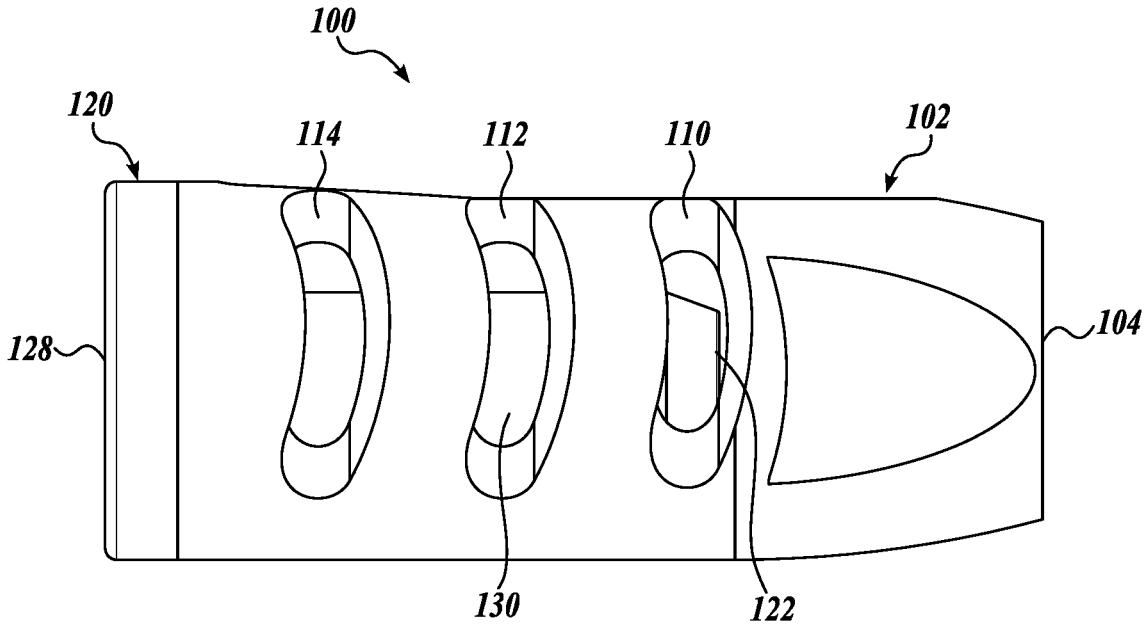
FIG. 7 is right elevational view of the muzzle brake of FIG. 1.
Figure 8:
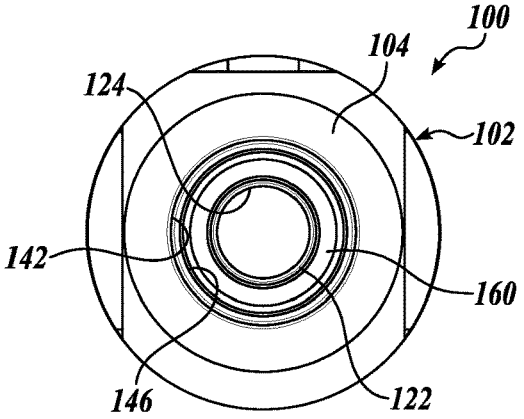
FIG. 8 is rear elevational view of the muzzle brake of FIG. 1.
Figure 9:
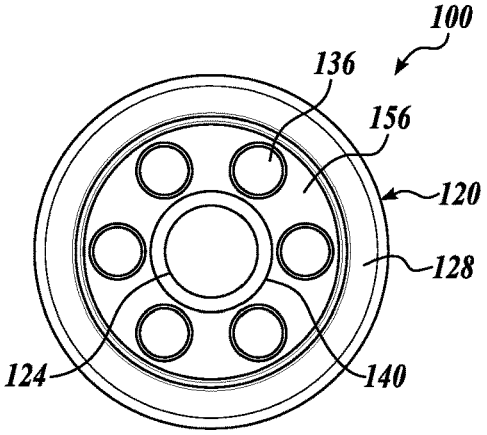
FIG. 9 is front elevational view of the muzzle brake of FIG. 1.

As shown in FIGS. 6 and 7, in some embodiments, the first, second, and third lateral ports 110, 112, and 114 are positioned upward of a central axis, generally mirror symmetrically from a vertical plane intersecting the projectile axis. In these embodiments, the first, second, and third lateral ports 110, 112, and 114 may further contribute to counteract muzzle rise. In some embodiments, the lateral ports are generally oblong shaped, as illustrated. However, in other embodiments, the lateral ports are any suitable shape and direction to counteract at least one of recoil and muzzle rise.

Returning to FIGS. 2 and 3, features of the insert 120 will now be explained in greater detail. In some embodiments, the insert 120 includes a tube body 130 having the central bore 124 through which a projectile travels, a first baffle 132, a second baffle 134, and a stop wall 158. In some embodiments, the central bore 124 includes a chamfered outlet 140 to more gradually allow the expansion of the gases exiting the tube body 130. As shown in FIG. 10, in certain embodiments, the first baffle 132 generally aligns with both the upward port 108 and the first lateral ports 110. In a similar manner, in certain embodiments, the second baffle 134 generally aligns with the second lateral ports 112. Further, in certain embodiments, the insert includes the stop wall 158 generally aligned with the third lateral ports 114. In other embodiments, the baffles 132 and 134 are aligned in any suitable location along the tube body 130. In further embodiments, a single baffle may be used, or more than two baffles may protrude from the tube body 130.

In some embodiments, the insert 120 includes a tapered portion 160 disposed at the proximal end 122 of the insert 120. The tapered portion 160 is configured to divert a portion of the gases expelled during use of the firearm away from the central bore 124 and toward the baffles 132 and 134, the upward port 108, and the lateral ports 110, 112, and 114. In this regard, the portion of the gases diverted and redirected by the tapered portion 160 into main central cavity 148 during use of the firearm travels through the ports in the housing 102 to create the forces that counteract recoil and muzzle rise.

As shown, the alignment and configuration of the first baffle 132 directs a portion of the gases diverted by the tapered portion 160 radially outward from the tube body 130 and toward the upward port 108 and the first lateral ports 110. The remaining gases not directed by the first baffle 132 travel toward the stop wall 158 and encounter the second baffle 134. In this configuration, the second baffle 134 directs a further portion of the gases, diverted by the tapered portion 160 that bypass the first baffle 132, radially outward from the tube body 130 and toward the second lateral ports 112. Finally, the remaining gases not directed by the first baffle 132 and the second baffle 134 continue to travel toward the stop wall 158, which directs the remainder of the gases toward the third lateral ports 114. In some embodiments, one or both of the first and second baffles 132 and 134 include features to control gas flow characteristics, such as fluting shown in the FIGURES.

The present application may include references to directions, such as "forward," "rearward," "front," "rear," "upward," "downward," "top," "bottom," "right hand," "left hand," "lateral," "medial," "in," "out," "extended," etc. These references, and other similar references in the present application, are only to assist in helping describe and to understand the particular embodiment and are not intended to limit the present disclosure to these directions or locations.

The present application may also reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. The terms "about," "approximately," "near," etc., mean plus or minus 5% of the stated value. For the purposes of the present disclosure, the phrase "at least one of A, B, and C," for example, means (A), (B), (C), (A and B), (A and C), (B and C), or (A, B, and C), including all further possible permutations when greater than three elements are listed.

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

The embodiments of the invention in which an exclusive property or privilege is claimed are defined as follows:

1. A muzzle brake for a firearm, comprising:

a housing having a chamber, a proximal end, and a distal end;

an insert removably couplable to the distal end of the housing, the insert having a tubular body with a central bore defining a projectile axis, the central bore at least partially extending toward the proximal end of the housing within the chamber;

a first lateral port extending from the chamber through the housing and configured to expel combustion gases away from the housing; and a first annular baffle projecting radially from the tubular body and disposed at a location along the tubular body configured to direct a portion of combustion gases entering the chamber toward the first lateral port.

2. The muzzle brake of claim 1, wherein the first lateral port comprises two apertures extending from the chamber through the housing, the apertures being mirror symmetrical to each other about a vertical plane intersecting the projectile axis.

3. The muzzle brake of claim 1, wherein the first lateral port is disposed at an angle such that the combustion gases have a velocity component toward the proximal end during expulsion.

4. The muzzle brake of claim 1, further comprising an upward port extending from the chamber through the housing and configured to expel combustion gases away from the housing in direction corresponding to the direction of muzzle lift of the firearm.

5. The muzzle brake of claim 4, wherein the upward port is disposed at an angle such that the combustion gases have a velocity component toward the proximal end during expulsion.

6. The muzzle brake of claim 1, wherein the tubular body forms an elongate tube and an end of the tubular body facing the proximal end includes a tapered portion configured to divert a portion of combustion gases entering the chamber toward the first annular baffle.

7. The muzzle brake of claim 1, further comprising a second lateral port pair extending from the chamber through the housing and configured to expel combustion gases away from the housing, and a second annular baffle projecting radially from the tubular body and disposed at location along the tubular body configured to direct a portion of the combustion gases toward the second lateral port pair.

8. The muzzle brake of claim 1, wherein the insert is removably couplable to the housing using mechanical connection selected from the group consisting of a threaded joint, twist-to-lock features, a retaining ring, a clamp, a pin, interference fit, and welding.

9. The muzzle brake of claim 1, wherein the insert comprises an engaging feature configured to aid in installation and removal of the insert from the housing.

10. The muzzle brake of claim 1, wherein the housing comprises a mechanical coupling portion configured to interface a barrel of the firearm, the mechanical coupling selected from the group consisting of a threaded joint, twist-to-lock features, a retaining ring, a clamp, a pin, interference fit, and welding.

11. A muzzle brake assembly, comprising:

a housing having a chamber with a first lateral port extending therethrough configured to expel combustion gases away from the housing with a velocity component toward a proximal end of the housing;

an insert removably coupled to a distal end of the housing, the insert having an elongate tubular body with a central bore defining a projectile axis, the central bore at least partially extending toward the proximal end of the housing within the chamber; and a first annular baffle projecting radially from the elongate tubular body and disposed at a location along the elongate tubular body configured to direct a portion of combustion gases entering the chamber toward the first lateral port.

12. The muzzle brake assembly of claim 11, wherein the first lateral port comprises two apertures extending from the chamber through the housing, the apertures being mirror symmetrical to each other about a vertical plane intersecting the projectile axis.

13. The muzzle brake assembly of claim 11, further comprising an upward port extending from the chamber through the housing and configured to expel combustion gases away from the housing in direction corresponding to the direction of muzzle lift of a firearm.

14. The muzzle brake assembly of claim 13, wherein the upward port is disposed at an angle such that combustion gases exiting the upward port have a velocity component toward the proximal end during expulsion.

15. The muzzle brake assembly of claim 11, wherein an end of the elongate tubular body facing the proximal end includes a tapered portion configured to divert a portion of combustion gases entering the chamber toward the first annular baffle.

16. The muzzle brake assembly of claim 11, further comprising a second lateral port pair extending from the chamber through the housing and configured to expel combustion gases away from the housing, and a second annular baffle projecting radially from the elongate tubular body and disposed at location along the elongate tubular body configured to direct a portion of combustion gases entering the chamber toward the second lateral port pair.

17. The muzzle brake assembly of claim 11, wherein the insert is removably couplable to the housing using mechanical connection selected from the group consisting of a threaded joint, twist-to-lock features, a retaining ring, a clamp, a pin, and welding.

18. The muzzle brake assembly of claim 11, wherein the insert comprises an engaging feature configured to aid in installation and removal of the insert from the housing.

19. The muzzle brake assembly of claim 11, wherein the housing comprises a mechanical coupling portion configured to interface a barrel of the firearm, the mechanical coupling selected from the group consisting of a threaded joint, twist-to-lock features, a retaining ring, a clamp, a pin, and welding.

20. A firearm having a muzzle brake, comprising:

a barrel; and a muzzle brake assembly disposed at an end of the barrel configured to expel a projectile, the muzzle brake assembly comprising:

a housing having a chamber with a first lateral port and an upward port extending therethrough configured to expel combustion gases away from the housing with a velocity component toward the barrel;

an insert removably coupled to a distal end of the housing, the insert having an elongate tubular body with a central bore defining a projectile axis, the central bore at least partially extending from the distal end toward the barrel within the chamber; and a first annular baffle projecting radially from the elongate tubular body and disposed at a location along the elongate tubular body configured to direct a portion of combustion gases entering the chamber toward the first lateral port and the upward port.

* * * * *